United States Patent [19]

Helsper et al.

[11] Patent Number: 4,967,958

[45] Date of Patent: Nov. 6, 1990

[54] APPARATUS FOR PRODUCING A SOLID AEROSOL

[75] Inventors: Christoph Helsper, Karlsruhe; Leander Mölter, Stutensee; Friedrich Munzinger, Karlsruhe; Werner Sturn, Jockgrimm, all of Fed. Rep. of Germany

[73] Assignee: Palas GmbH Partikel-und Lasermesstechnik, Karlsruhe, Fed. Rep. of Germany

[21] Appl. No.: 243,824

[22] Filed: Sep. 13, 1988

[30] Foreign Application Priority Data

Aug. 4, 1988 [DE] Fed. Rep. of Germany ... 8809948[U]

[51] Int. Cl.[5] ..... B05B 1/24

[52] U.S. Cl. ..... 239/81; 239/84; 73/1 G; 261/104

[58] Field of Search ..... 361/225, 226, 227, 228, 361/230, 233; 239/81, 83, 84, 85; 118/638; 427/35, 37, 38, 39, 122; 422/186.22, 186.26; 219/121.15, 124.02, 124.03, 121.52, 121.53; 75/0.5 C, 10.23; 73/1 G; 261/99, 104, 107; 307/154, 157

[56] References Cited

U.S. PATENT DOCUMENTS

| | | | |
|---|---|---|---|
| 883,594 | 3/1908 | Viel | 422/186.22 X |
| 1,051,131 | 1/1913 | Lee | 422/186.26 X |
| 2,447,426 | 4/1943 | Odberg | 422/186.22 X |
| 2,856,237 | 10/1958 | Monroe | 239/84 X |
| 4,512,513 | 4/1985 | Rogers | 239/8 |
| 4,670,290 | 6/1987 | Itoh et al. | 427/34 |
| 4,788,408 | 11/1988 | Wlodarczyk et al. | 219/121.49 |
| 4,851,254 | 7/1988 | Yamamoto et al. | 427/37 |

*Primary Examiner*—A. D. Pellinen
*Assistant Examiner*—David Osborn
*Attorney, Agent, or Firm*—Antonelli, Terry, Stout & Kraus

[57] ABSTRACT

An apparatus for producing a solid aerosol, such as a carbon aerosol, in which aerosol particles are produced by spark discharge via particle-supplying electrodes and the particles are entrained by a gas flow. Electrodes having parallel, adjacent end faces and are prvided with a feed drive moving them synchronously in a direction toward one another.

29 Claims, 4 Drawing Sheets

APPARATUS FOR PRODUCING A SOLID AEROSOL

BACKGROUND OF THE INVENTION

The invention relates to an apparatus for producing a solid aerosol, such as a carbon aerosol, in which the aerosol particles are produced by a spark discharge via particle-supplying electrodes and the particles are entrained by a gas flow.

Various means for producing a solid aerosol are known, e.g. particles can be removed from a column consisting of compacted carbon particles by a brush and introduced into a gas flow used for discharging the same. In order to produce a carbon aerosol a discharge across twp spaced carbon electrodes has been proposed. During the spark discharge the electrode material evaporates and individual particles condense in the gap between the electrodes. A gas flow flows around the electrodes and entrains the condensed particles and discharges them in aerosol form out of the apparatus. In the case of the latter apparatus it is only possible to produce aerosols with a limited concentration over a short time and on a laboratory scale since the electrodes "burn-up" and, consequently, the operating conditions change, so that no constant operation is possible.

The aim underlying the present invention essentially resides and further developing an apparatus of the aforementioned type so that, in adjustable manner over a considerable period of time, extremely constant particle concentrations can be obtained, with the apparatus being suitable for calibrating soot measuring devices, for filter tests and for inhalation experiments.

According to the invention, an apparatus for producing a solid aerosol, such as a carbon aerosol, is provided in which aerosol particles are produced by spark discharge via particle-supplying electrodes and the particles are entrained by a gas flow, with the electrodes having parallel adjacent end faces and a feed drive moving them synchronously opposite to one another. The inventive construction makes it possible to automatically keep the gap between the parallel facing front faces of the electrodes constant over a long period of time. Thus, a constant sparkover voltage and, consequently, a constant particle generator operation is obtained. The inventive apparatus in particular ensures that the electrodes always project symmetrically into the gas and particle supply channel and therefore the burn-up of the electrodes takes place centrally in the aerosol channel.

According to a preferred further development, the electrodes are driven by spindles with oppositely directed threads and, in particular, the electrodes are fixed to running supports, which are in engagement with spindles and the latter are driven by a motor via a toothed belt. As a result of this construction a uniform guidance of the electrodes is achieved, which is important for a uniform burn-up thereof and ensures a minimum change to the sparkover voltage. According to a further development it is possible to provide a regulating means for the electrode feed drive. Whereas fundamentally the electrode burn-up rate is constant, so that a controlled drive could be provided, this construction permits a broad adjustability of the particle concentration, in that in each case, the feed control is automatically locked as a function of the desired particle concentration and there is no need to provide different external control programs. In an extremely preferred development control takes place by a measuring device for the sparkover voltage between the facing sides of the electrodes. By measuring the sparkover voltage precisely the latter, whose constancy is sought, is used as a measured variable or given actual value for regulating the electrode gap and therefore in desired manner maintaining constant the sparkover voltage.

According to a further development of the invention a gas supply channel for carrier gas and particle flow is constructed in a PTFE body. As a result a minimum number of particles adheres to the aerosol channel, so that the discharged particle concentration could be modified.

The inventive construction leads to an aerosol generator, particularly for producing pure carbon aerosol, but also for producing aerosols of metals or inert gas or metal oxides when using corresponding metal electrodes, whose burn-up in the latter case is oxidized in an oxygen atmosphere as the propellant gas, which enables calibrations of measuring devices, filter tests and inhalation experiments to be carried out easily and very accurately.

BRIEF DESCRIPTION OF THE DRAWINGS

Further advantages and features of the invention can be gathered from the claims and the following description, which explains in detail an embodiment of the invention with reference to the accompanying drawings, wherein:

DETAILED DESCRIPTION

Figure 1:
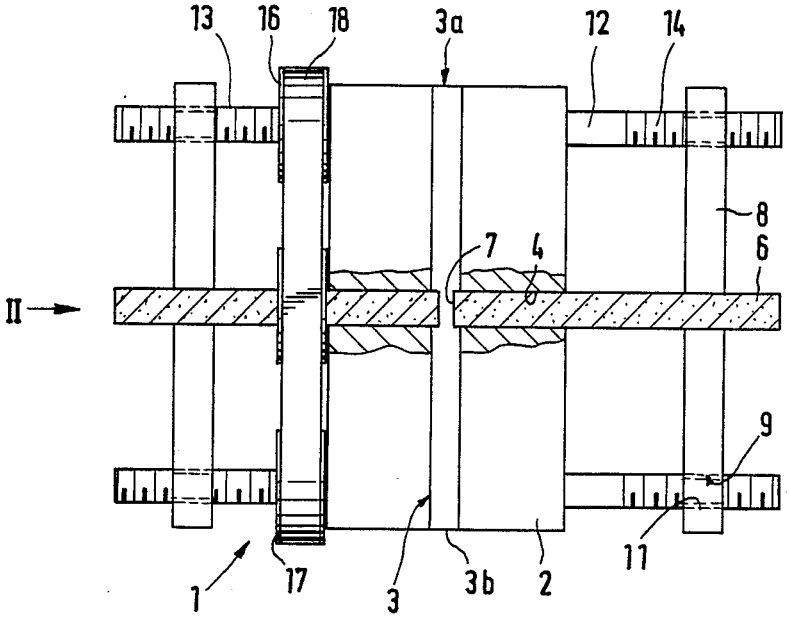
FIG. 1 is a schematic side view of a side arrangement for electrodes in an apparatus for producing a solid aerosol constructed in accordance with the present invention.

The inventive apparatus generally designated by the reference numeral 1 for generating a solid aerosol has an operational or functional block 2 made from PTFE or a corresponding material with poor adhesion characteristics, with the operational block 2 being constructed a gas supply channel generally designated by the reference numeral 3, preferably for an inert carrier gas such as argon or the like. To the gas supply channel 3 is connected a sparkover chamber generally designated by the reference numeral 3*a*, in which are vertically constructed guide passages 4 for solid electrodes 6 which issure centrally into the same in diagonal manner thereto. In the represented embodiment electrodes 6 are graphite electrodes. However, fundamentally other electrodes can be used, such as e.g. individual metal electrodes and, in this case, the carrier gas can be an oxygen-containing carrier gas in order to produce corresponding oxide aerosols.

Figure 3:
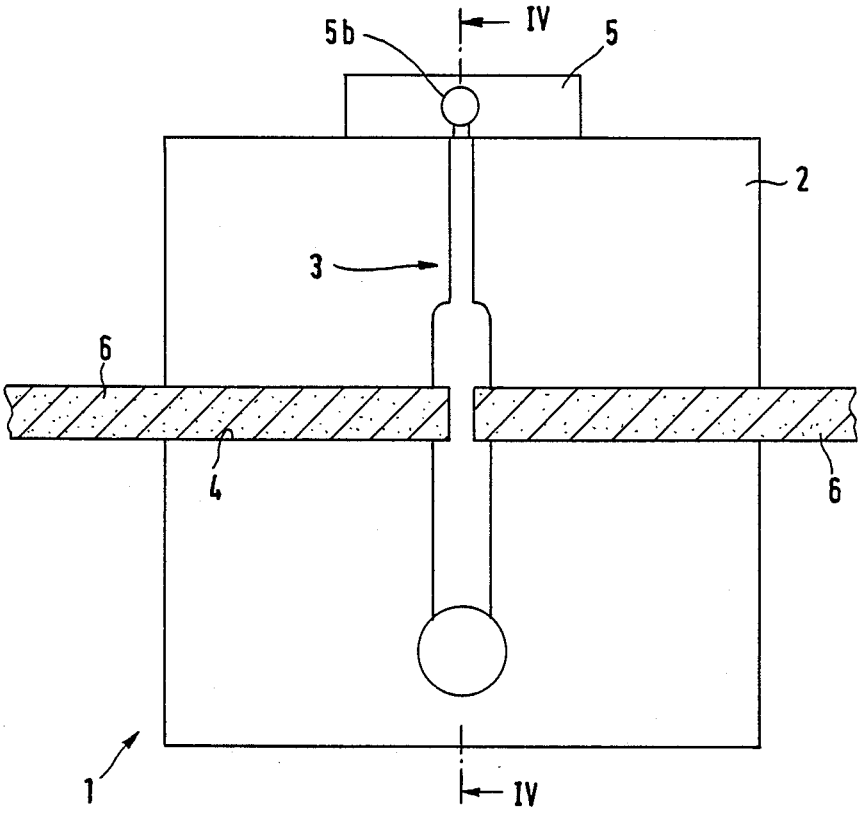
FIG. 3 is a schematic view of an operational plate of the apparatus for producing a solid aerosol constructed in accordance with the present invention with electrodes and a gas supply channel disposed at right angles thereto.

To the operational block 2 is fixed a gas guidance flange 5 (FIG. 3), which is provided with a gas inlet connection 5*a* (FIG. 4), which forms a gas connection to the gas supply channel 3 in the operational block 2 via a cross-bore 5b and gas supply bores 5c. The several small gas supply bores 5a give a uniform gas flow distribution. The gas supply channel 3 has a substantially rectangular cross-section. The ratio of the cross-sectional width in the extension direction of the electrodes 6 to the cross-sectional length at right angles thereto is preferably below 1:10, with the width being smaller than 1 mm and smaller than the electrode gap. Upstream of the electrodes 6, the gas supply channel 3 widens towards the discharge chamber 3a, whose cross-sectional width and length are roughly of the same order of magnitude. As a result of this construction, the carrier gas can flow in substantially laminar manner without significant turbulence formation between the electrodes 6 and following a discharge between the electrodes 6, during which particles are released therefrom which form the aerosol particles, can pass rapidly out of the sparkover chamber, which permits a high discharge frequency and therefore a high aerosol particle rate.

Discharge chamber 3a issues at 3b into an aerosol outlet channel 3c, in which a dilution gas nozzle 10 is arranged in the entry region 3b. This makes it possible to increase the flowing gas quantity, while retaining the high particle rate produced by the possible high discharge frequency. Simultaneously the concentration of the aerosol particles in the increased gas quantity can be reduced over the entire cross-sectional width of the outlet channel 3a, so that it is possible to reliably prevent an agglomeration of aerosol particles to larger structures (chains, flakes, etc.).

In particular another gas can be admixed here. For example, it is possible to admix air, which can be passed through the discharge chamber not directly with or instead of the carrier gas argon, because the particles detached during the discharge (carbon and metal particles in the case of metal electrodes, if a corresponding aerosol is desired) would oxidize (burn) in the discharge plasma. Thus, there is no problem in connection with a subsequent admixing of oxygen and compared with the use of an inert noble gas only as the carrier constitutes a less expensive solution. Through the construction of the mixed gas supply as a nozzle 10, a penetration of the mixed gas into the area between the electrodes 6 is reliably prevented.

Electrodes 6 have flat, parallel directed, facing end faces 7 and are secured in support members 8 having guide passages 9 with an internal thread 11 and are located with the guide passages accommodating the spindles 12, which pass through the operational block 2 in freely rotatable manner, and project over the same on either side, and, at their projecting ends, are provided with oppositely directed threads 13, 14. In the represented embodiment of FIG. 1 there is a left-handed thread 13 to the left of block 2 and a right-handed thread to the right of said block 2.

Figure 2:
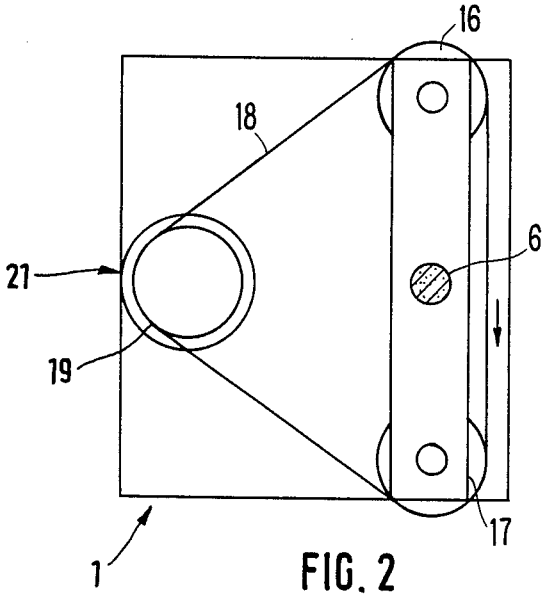
FIG. 2 is a view taken a direction of the arrow II in FIG. 1.

On both spindles are located ratchet wheels 16, 17 over which is guided a common toothed belt 18, which also passes over a ratchet wheel 19 of a drive motor 21 as shown most clearly in FIG. 2.

Figure 4:
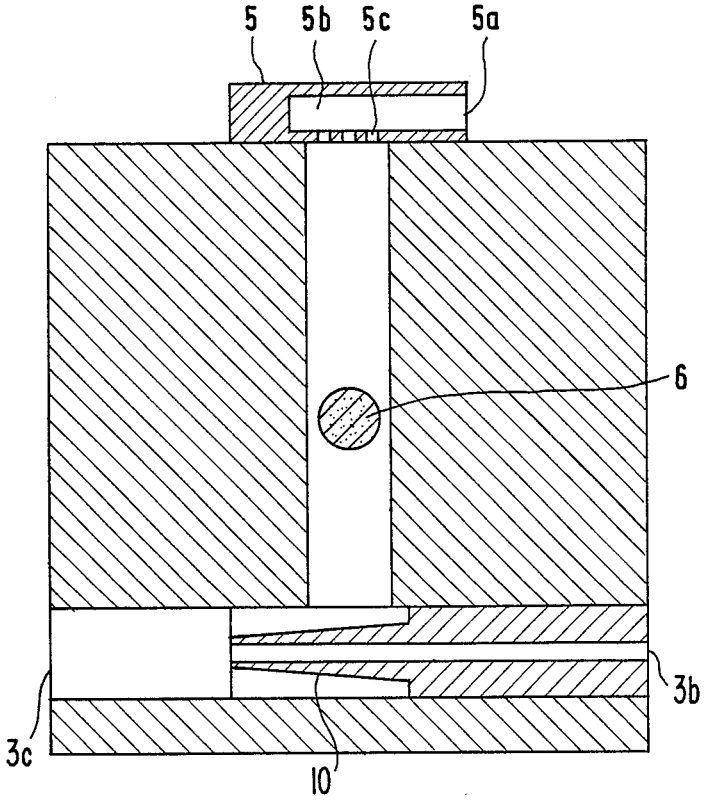
FIG. 4 is a cross-sectional view taken along the line IV—IV in FIG. 3.
Figure 5:
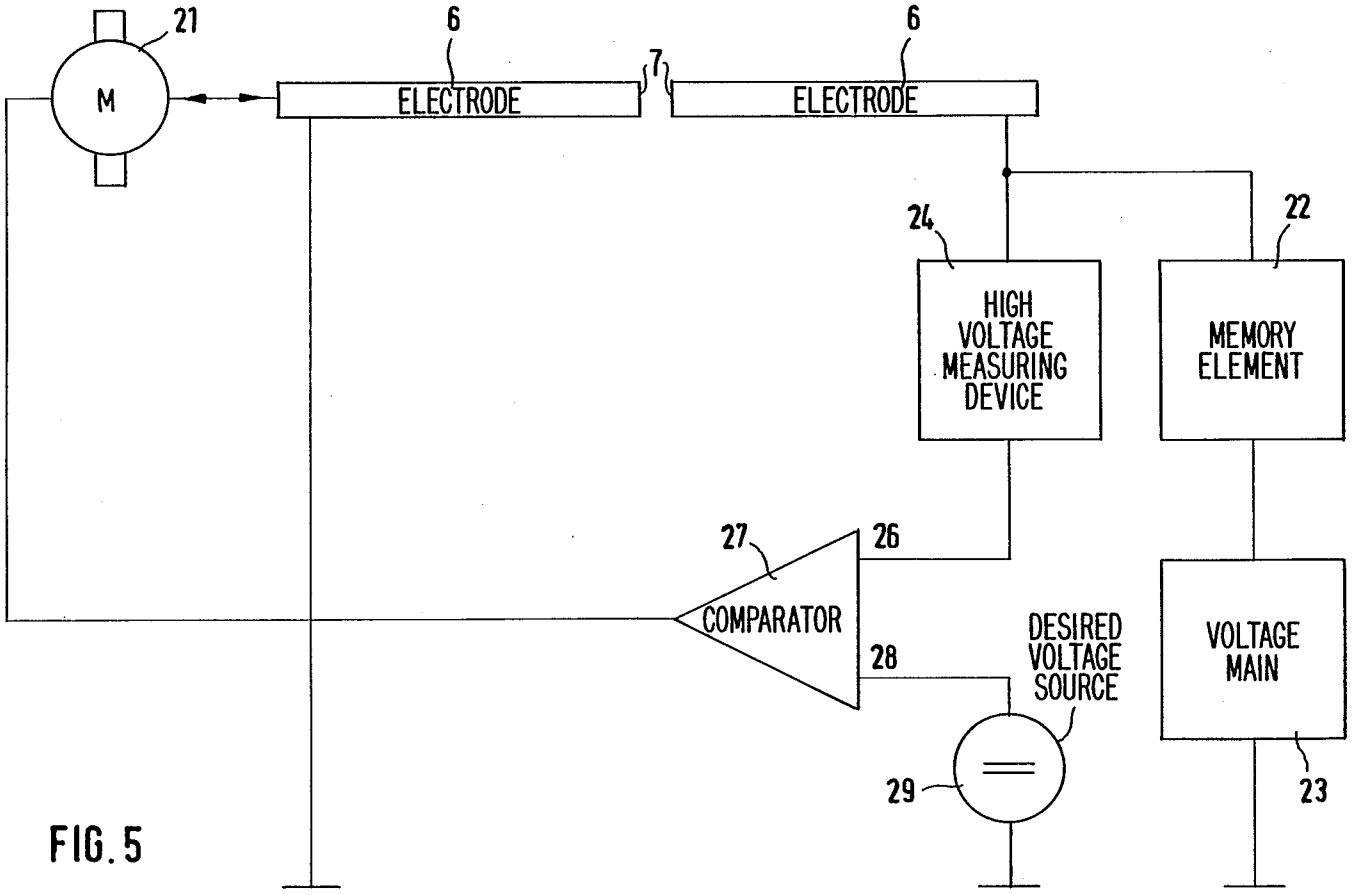
FIG. 5 is a schematic electric circuit diagram.

As shown in FIG. 4, electrodes 4 are connected across a memory element 22, such as e.g. a RC network to a high voltage main 23, which optionally has a transformer T (one of the electrodes via ground, the other directly with the other pole of the voltage main 23 across the memory element). The applied high voltage generates voltage peaks, which lead to a spark formation between the electrodes 6.

At electrode 6 directly connected to the high voltage main 23 is provided a high voltage measuring device 24, which leads to an input 26 of a comparator 27 and at whose other input 28 is a reference voltage of a desired voltage source 29 (relative to ground) representative of the desired spacing of the electrodes 6. Comparator 27 compares the two voltages at its inputs 26, 28 and regulates the electrode drive motor 21 in accordance with their difference. Thus, the sparkover voltage between the electrodes 6 is measured and by its value the electrode gap between the end faces 7 of the electrodes 6 is automatically regulated. This leads to a constant sparkover voltage and a constant generator operation.

We claim:

1. Apparatus for producing a carbon aerosol with a high mass constancy and small reproducible particle sizes, the apparatus comprising a pair of carbon particle-supplying electrode means having substantially parallel end faces disposed in opposition to each other, means for applying individual voltage peaks of high repetition frequency to evaporate material of the carbon particle-supplying electrode means by individual electrical sparks between the carbon particle-supplying electrode means, means for directing a gas flow between the carbon particle-supplying electrode means to entrain solid carbon particles generated by condensation of the evaporated electrode material, and feed drive means for moving the carbon particle-supplying electrode means synchronously in a direction toward one another.

2. Apparatus according to claim 1, further comprising means for regulating the feed drive means of the electrode means.

3. Apparatus according to claim 2, further comprising means for measuring a sparkover voltage between the opposed end faces of the electrode means.

4. Apparatus according to claim 1, wherein said means for directing includes a gas supply channel means for a carrier gas and aerosol particle flow fashioned in a PTFE body.

5. Apparatus according to claim 4, further comprising a dilution gas nozzle means disposed behind the electrode means in an aerosol outlet of the supply channel means.

6. Apparatus according to claim 5, wherein the aerosol outlet extends at right angles to the gas supply channel means in a vicinity of the electrode means.

7. Apparatus according to claim 5, wherein an opening of the dilution gas nozzle means issues downstream of an opening of the gas supply channel means in the aerosol outlet.

8. Apparatus according to claim 1, wherein the means for directing includes a gas supply channel means disposed forwardly of the electrode means, said gas supply channel means including a slit having a width smaller than a spacing between the opposed end faces of the electrode means.

9. Apparatus according to claim 8, wherein a ratio of a cross-sectional width to a cross-sectional length of the gas supply channel means is less than 1:10.

10. Apparatus according to claim 8, wherein the gas supply channel means has a cross-sectional width in an extension direction of the electrode means which is less than 1 mm.

11. Apparatus according to claim 8, wherein the gas supply channel means in front of the electrode means continuously passes into a discharge chamber means into which the electrode means project.

12. Apparatus for producing a solid aerosol with a high mass constancy and small reproducible particle sizes, the apparatus comprising a pair of particle-supplying electrode means having substantially parallel faces disposed in opposition to each other, means for applying individual voltage peaks of high repetition frequency to evaporate material of the electrode means by individual electrical sparks between the electrode means, means for directing a gas flow between the electrode means to entrain solid particles generated by condensation of the evaporated electrode material, and feed drive means for moving the electrode means synchronously in a direction toward one another said drive means includes spindle means with oppositely directed threads.

13. Apparatus according to claim 12, wherein the electrode means are respectively fixed on running blocks engaged, which are in with the spindle means.

14. Apparatus according to claim 12, wherein the feed drive means further includes motor means for driving the spindle means via a toothed belt means.

15. An apparatus according to claim 12, further comprising means for regulating the feed drive means of the electrode means.

16. Apparatus according to claim 15, further comprising means for measuring a spark overvoltage between the opposed end faces of the electrode means.

17. Apparatus according to claim 12, wherein said means for directing includes a gas supply channel means for a carrier gas and aerosol particle flow fashioned in a PTFE body.

18. Apparatus according to claim 17, further comprising a dilution gas nozzle means disposed behind the electrode means in an aerosol outlet of the supply channel means.

19. Apparatus according to claim 18, wherein the aerosol outlet extends at right angles to the gas supply channel means in a vicinity of the electrode means.

20. Apparatus according to claim 18, wherein an opening of the dilution gas nozzle means issues downstream of an opening of the gas supply channel means in the aerosol outlet.

21. Apparatus according to claim 12, wherein the means for directing includes a gas supply channel means disposed forwardly of the electrode means, said gas supply channel means including a slit having a width smaller than a spacing between the opposed end faces of the electrode means.

22. Apparatus according to claim 21, wherein a ratio of a cross-sectional width to a cross-sectional length of the gas supply channel means is less than 1:10.

23. Apparatus according to claim 21, wherein the gas supply channel means has a cross-sectional width in an extension direction of the electrode means which is less than 1 mm.

24. Apparatus according to claim 21, wherein the gas supply channel means continuously passes into a discharge chamber means into which the electrode means project.

25. Apparatus according to claim 2 wherein the solid aerosol is a carbon aerosol.

26. A method for generating a carbon aerosol with a high mass constancy and small reproducible particle sizes, the method comprising the steps of generating individual electric sparks at a high repetition frequency by a high voltage applied to a pair of carbon particle-supplying electrode means so as to evaporate material from opposed flat end faces of the electrode means aligned parallel to each other by high voltage spark discharge so as to form very small carbon particles by condensation, entraining the carbon particles in a gas stream, and controlling a synchronous movement of the electrode means in a direction toward one another.

27. A method according to claim 26, wherein the step of controlling a synchronous movement includes regulating a feed drive means for driving the electrode means in a direction toward one another.

28. A method according to claim 27, further comprising the step of measuring a spark over voltage between opposed end faces of the electrode means.

29. A method according to one of claims 26 or 27 further comprising the step of supplying a dilution gas at a position behind the electrode means in an aerosol outlet of a gas supply channel means.

* * * * *